US006106226A

United States Patent [19]

Morando

[11] Patent Number: 6,106,226

[45] Date of Patent: Aug. 22, 2000

[54] HIGH VELOCITY PRESTRESSED SHAFT FOR DEGASSER OR PUMPING APPLICATION IN MOLTEN METAL

[75] Inventor: Jorge A. Morando, Cadiz, Ky.

[73] Assignee: Alphatech, Inc., Cadiz, Ky.

[21] Appl. No.: 09/444,443

[22] Filed: Nov. 22, 1999

Related U.S. Application Data

[63] Continuation-in-part of application No. 09/130,937, Aug. 7, 1998.

[51] Int. Cl.[7] ..... F01D 25/26

[52] U.S. Cl. ..... 415/135; 415/115; 415/178; 415/180; 415/200

[58] Field of Search ..... 415/115, 116, 415/135, 136, 178, 180, 200; 266/233, 239

[56] References Cited

U.S. PATENT DOCUMENTS 3,776,660 12/1973 Anderson et al. ..... 415/196
5,181,828 1/1993 Gilbert et al. ..... 415/200

*Primary Examiner*—Edward K. Look
*Assistant Examiner*—Ninh Nguyen
*Attorney, Agent, or Firm*—Charles W. Chandler

[57] ABSTRACT

A rotating shaft for pumping or degassing hydrogen from molten metal comprising a motor connected to the upper end of a hollow shaft. An impeller is connected to the lower end of the shaft in the molten metal. The shaft is telescopically housed within a heat resistant shield shaft. The shield is clamped in a state of longitudinal compression to prevent tensile forces from damaging the shield as the impeller is being rotated.

34 Claims, 3 Drawing Sheets

HIGH VELOCITY PRESTRESSED SHAFT FOR DEGASSER OR PUMPING APPLICATION IN MOLTEN METAL

CROSS-REFERENCE OF RELATED APPLICATION

This application is a continuation-in-part of U.S. patent application Ser. No. 09/130,937, filed Aug. 7, 1998, for "Advanced Motor Driven Impeller Pump for Moving Metal in a Bath of Molten Metal."

BACKGROUND OF THE INVENTION

This invention is related to a degassing apparatus for agitating and injecting a gas into molten aluminum to remove hydrogen gas. The apparatus has a shaft which includes a prestressed, tubular shield that is in a state of longitudinal compression as it is being rotated.

Hydrogen gas becomes entrapped in aluminum during the recycling process and must be removed because the aluminum makes a brittle casting. Humidity also reacts with oxygen and becomes aluminum oxide forming end products of aluminum plus hydrogen.

Conventional practice is to agitate the aluminum using nitrogen and/or other gases (argon, chlorine, carbon dioxide) in a process called degassing. Conventional agitating devices have a short life because the heat of the molten aluminum rapidly corrodes or burns many materials used for the shaft connecting the motor to the agitating impeller. Heat resistant graphite tubing is used to protect the shaft, usually with a ceramic shielding. However, high-speed shaft vibrations cause cyclical tensile stresses. Graphite has very poor tensile strength and therefore is unsuitable for high speeds. Graphite also has a very short life (days) because it burns at the metal line.

SUMMARY OF THE INVENTION

The broad purpose of the present invention is to provide an improved agitator shaft structure for use in either degassing or pumping molten metals, such as aluminum. Preferably, the shaft is enclosed in a tubular shield made of materials highly resistant to the heat of the molten aluminum, such as graphite or ceramic. If graphite is used, the ceramic shielding should be similar to that disclosed in my pending patent application Ser. No. 09/130,937, filed Aug. 7,1998.

In the preferred embodiment of the invention, the shaft structure employs a hollow tubular metal shaft. A motor is connected to the upper end of the shaft, and an agitator impeller to the lower end, in the molten metal. A tubular shield of a material that is heat resistant in molten aluminum, encloses the shaft. A pair of fasteners mounted on the upper and lower threaded ends of the shaft clamps the shield in a state of longitudinal compression. The compression prevents the shield material, such as a ceramic, from experiencing tensile loads as the vibrating shaft is rotated. Further, the shield and the shaft are dynamically balanced, to reduce shaft vibrations.

Nitrogen or another scrubbing gas is introduced into the upper end of the shaft and delivered to orifices in the lower end of the shield into the molten aluminum for degassing hydrogen from the metal.

The preferred shaft assembly has a longer life, and can be rotated at higher speeds than a shaft using a similar shield material that is not prestressed. The shaft assembly can be used as a pump member, or in other applications where a shaft is disposed in molten metal.

Still further objects and advantages of the invention will become readily apparent to those skilled in the art to which this invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
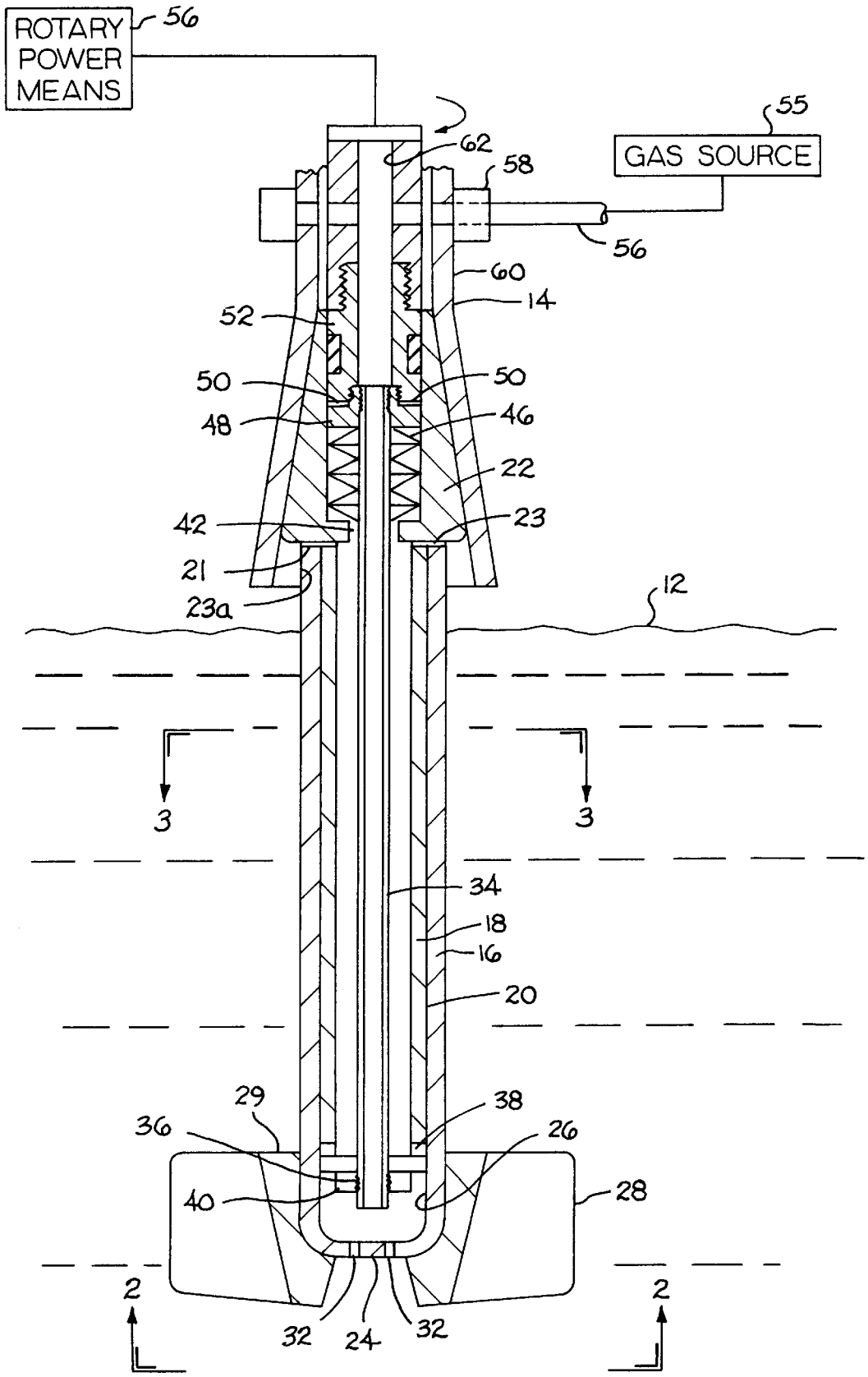
FIG. 1 is a longitudinal sectional view through a degassing apparatus having a prestressed shat assembly illustrating the preferred embodiment of the invention.

FIG. 1 illustrates a preferred degassing apparatus 10. Apparatus 10 is suspended by any suitable means, not shown, in a bath of molten aluminum 12. For illustrative purposes, the aluminum is being recycled and contains hydrogen gas. Nitrogen gas is delivered by the degassing apparatus to a lower portion of the bath of aluminum, to remove the hydrogen from the molten metal.

Apparatus 10 comprises a gas supply fitting means 14, and a rotatable shaft assembly, which includes a multi-layer shield assembly including an outer tubular ceramic shield 16 and an inner tubular ceramic shield 18. Shield 18 is telescopically disposed in shield 16, and their adjacent cylindrical surfaces attached together by a layer of ceramic cement 20. More than two shield layers can be employed. The overall thickness of the shield is proportional to the shaft load.

The upper ends of shields 16 and 18 are flush and engage an annular seat 21 in a tapered gas supply fitting 22. A foil gasket 23 is disposed between the upper shield ends and seat 21 to form a gas-tight seal. The shields are slidably engaged with opening 23*a* in fitting 22.

The lower end of outer shield 16 extends below the lower end of the inner shield, and has a cup-shaped bottom 24 forming a gas chamber 26.

A multi-vaned agitating impeller 28 is attached by a ceramic cement 29 to the lower end of the outer shield adjacent the lower end of the inner shield to minimize tensile stress on the two shields, and to take advantage of the ceramic's high shear strength properties. The impeller could be threaded to the driving shaft.

Figure 2:
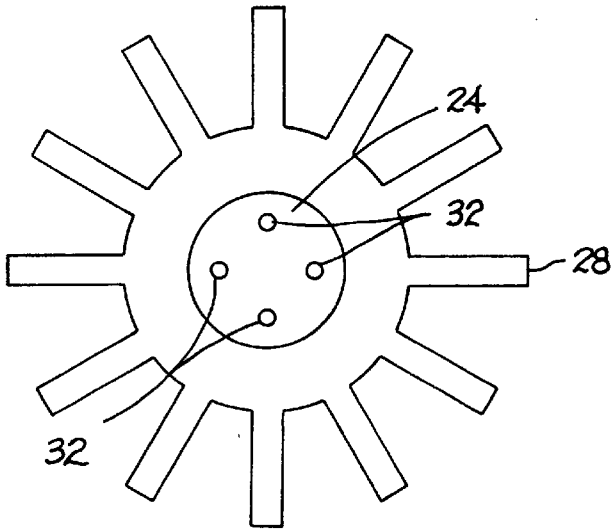
FIG. 2 is an enlarged bottom view of the degassing apparatus, as seen along lines 2—2 of FIG. 1.
Figure 3:
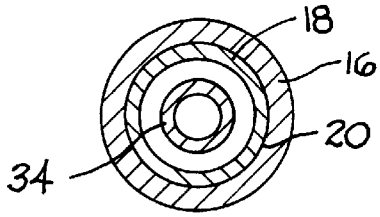
FIG. 3 is a sectional view taken along lines 3—3 of FIG. 1.

Referring to FIGS. 1 and 2, bottom 24 of the outer shield has a plurality of sonic orifices 32 for delivering nitrogen from gas chamber 26 toward the bottom of the bath of molten metal. The bottom location Of the orifices and the downward direction in which they deliver the nitrogen gas is intended to increase the residence time of the rising nitrogen gas in the metal.

An elongated tubular alloy steel shaft 34 is telescopically disposed within the inner tubular shield, and has its longitudinal axis concentric with that of the two ceramic shields. The lower end of shaft 34 is externally threaded at 36, and extends below the lower end of the inner ceramic shield.

Figure 4:
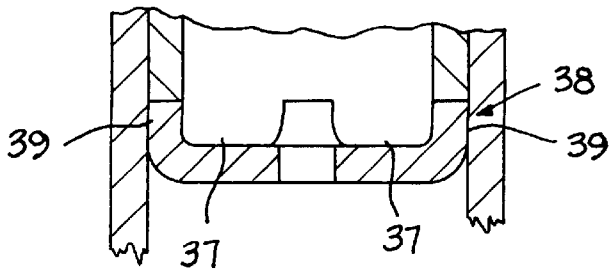
FIG. 4 is an enlarged sectional view of the lower ends of the inner shield with the shaft and lower clamping nut omitted for clarification.

Referring to FIG. 4, the lower end of shield 18 has axially extending teeth 37. A washer 38 is seated on the lower end of the inner shield, and around the lower end of shaft 34. Washer 38 has axial teeth 39 meshed with teeth 37 to drive the shaft. A lower clamping nut 40 is threadably mounted on the lower end of shaft 34.

The ceramic shields cooperate to support the drive shaft axis concentric with the impeller axis of rotation to reduce vibration of the shaft caused by the rotating impeller.

Gas supply fitting 22 is hollow, externally tapered and has a bore 42, which receives the upper end of shaft 34. Fitting 22 has an internal annular shoulder 44 below the upper end of the shaft and above the upper ends of the two ceramic shields. A series of belleville springs 46 are seated on shoulder 44 around the shaft. An upper clamping nut 48 is threadably mounted on the shaft above the belleville spring. Nut 48 has a pair of openings 50 for receiving a spanner wrench (not shown) for tightening the nut on the shaft to compress springs 46.

An annular guide lock 52 is threadably mounted on the shaft in abutment with clamping nut 48 to lock it in an adjusted position. The guide lock carries an annular seal 54 to provide a gas-tight seal between the guide lock and gas fitting 22.

A rotary power means 56 is drivingly connected to the shaft so that the shaft, the two ceramic shields and the impeller rotate as a unit. As such, the unit can be dynamically balanced for operation at rotary speeds greater than 400 rpm versus present top speeds of 200 rpm.

To assemble the degassing assembly, the shaft is inserted in the inner ceramic shield. Washer 38 and lower clamping nut 40 are threadably mounted on the lower end of the shaft. The washer is locked in place to the end of the inner shield by nut 40. The outer surface of the inner shield is then coated with ceramic adhesive 20 and inserted in the outer shield until the upper end of the inner shield is flush with the upper end of the outer shield. This then forms an integral laminated shielding unit for the shaft.

Gas fitting 22 is then mounted on the upper end of the shaft after foil gasket 23 has been disposed between the shields and the gas fitting. The belleville springs are inserted in the bore of the gas fitting. When adhesive 20 has cured, upper clamping nut 48 is tightened with a spanner wrench, not shown, to longitudinally compressively prestress both the inner and the outer ceramic shields between the upper and lower clamping nuts. This prestress prevents the application of a distinctive tensile stress on the ceramic shields as the shaft assembly is being rotated. Guide lock 52 is inserted with seal 54 in the gas fitting bore to lock the upper clamping nut in its adjusted position.

The entire length of the inner shield is prestressed with that part of the outer shield cemented to the inner shield. The outer shield is attached to the impeller in a location such that essentially only a shear force is applied to the lower end of the outer shield by the impeller load. The ceramic is available from Alphatech, Inc. of Cadiz, Ky. and has an excellent shear strength so that it experiences basically only a shear force from the impeller.

Nitrogen gas is delivered from a source 55 through a conduit 56 to a coupling 58. Coupling 58 is stationary, but permits the rotation of on an outer hollow, tapered gas fitting 60 attached to gas fitting 22. The gas passes down through a passage 62, through shaft 34 into gas chamber 26, and out through sonic orifices 52 into the molten aluminum where it mixes with the aluminum to remove hydrogen gas.

Small orifices that can not erode due to gas velocity and temperature, provide smaller gas bubbles to better penetrate into the aluminum bath. Degassing is improved because it is proportional to the residence time of the gas in the aluminum and inversely proportional to the diameter of the bubble. A greater surface area of the gas bubbles is exposed to the molten aluminum to "scrub" the hydrogen.

The two ceramic shields cooperate to make the drive shaft axis concentric with the impeller axis to reduce vibration of the shaft and the shields caused by the rotating impeller.

The shielding unit automatically compensates for the differences in the thermal elongation of shaft 34 and the shielding unit caused by the temperature of the molten metal. Both the inner and outer shields are formed of the same material so that they have the same coefficient of thermal expansion. However, the shaft 34 is of a steel alloy metal, which has a different coefficient of thermal expansion. Consequently, to compensate for the differences of thermal expansion, as the shaft elongates in response to thermal expansion, lower nut 40 will move slightly downwardly. The two shielding units will then slide downwardly with the nut because the upper end of the shields are slidably mounted in opening 23*a*. The belleville springs are arranged so the upper and lower nuts maintain their prestress on the shields, while at the same time permitting the shaft to elongate or shorten at a different rate than the shields. The shields and the impeller are thus floatably carried on the shaft.

Figure 5:
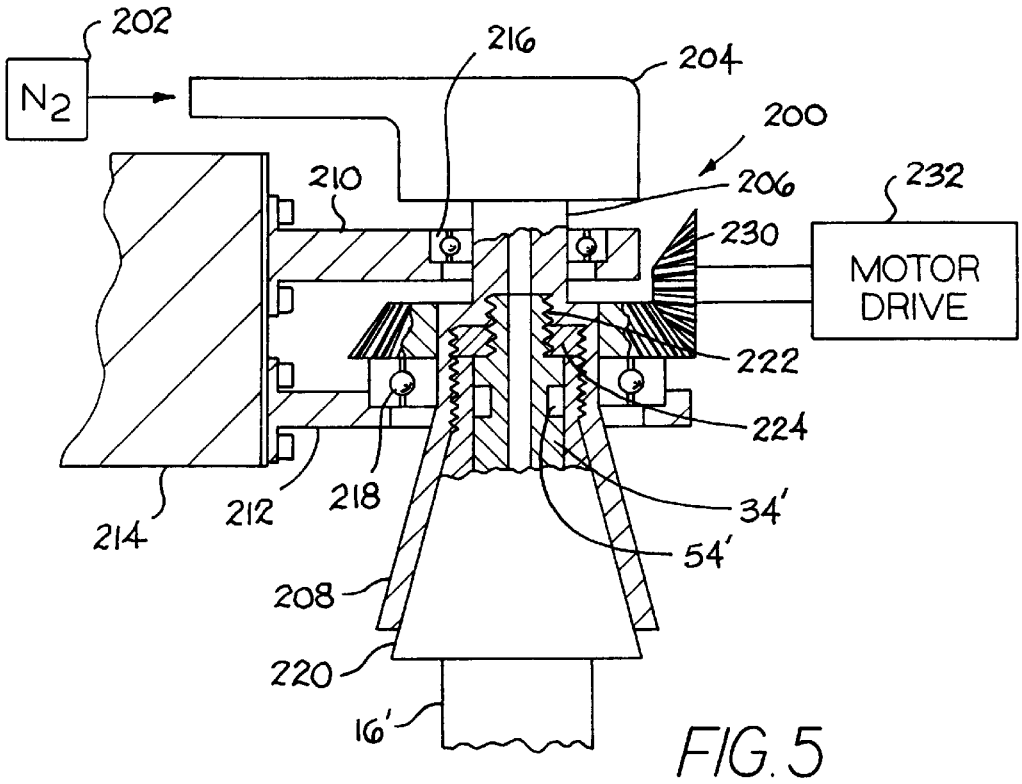
FIG. 5 illustrates an alternative drive system for the shaft.

Referring to FIG. 5, an alternative coupling structure 200 is illustrated for connecting a source of gas 202 to the hollow shaft. In this case, a universal gas coupling 204 is rotatably connected by a shaft 206 to a bell structure 208. Bell structure 208 is mounted on a pair of supports 210 and 212 to a base support 214 by bearing means 216 and 218. The outer bell is in turned threadably coupled to the driving bell 220, which is connected to shield 216'. Drive shaft 34' extends above the shield and has an upper end 222 threadably connected to shaft 206. A clamping nut 224 is threadably mounted on the shaft, and a K-wool or equivalent gasket mounted between the upper end of the shaft drive 34' and shaft 206. Seal 54' provides a gas tight seal between the shaft and the gas fitting. Gear means 230 connected to a motor drive 232 are mounted on shaft 206 to rotate the hollow shaft 34' and bell structure 208.

Figure 6:
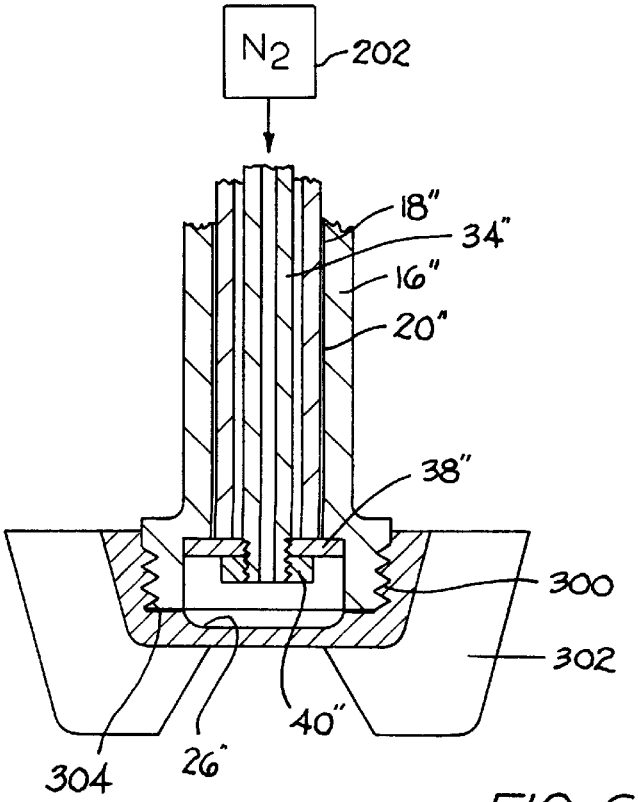
FIG. 6 illustrates the shield modified when the apparatus is being used as a pump.

FIG. 6 shows a variation of the lower end of the drive shaft in which the invention is used as a pumping member rather than as a degasser. In this case, shaft 34" is threadably connected to a lower nut 40". A washer is mounted between the nut, and the lower end of inner shield 18" and a step 19' on the outer shield 20". The two shields are attached together in a laminated fashion by an adhesive 18". In this case, the lower end of the outer shield is threaded at 300 for receiving a pumping member 302.

Note there is a gas chamber 26" at the lower end of the hollow drive shaft to allow inert gas to saturate foil gasket 304. The impeller 302 could be provided with orifices at the bottom of chamber 26 if utilized as a degasser shaft assembly.

The advantage of this arrangement is that both shields are in positive compression. The structure is easy to assemble. If the shaft is used as a pump the nitrogen source 202 is optional if no orifices are provided on impeller 302. The gas makes the structure leak proof.

Having described my invention, I claim:

1. Apparatus for moving molten metal in a bath of molten metal, comprising:

a rotatable moving member suited to be disposed in a bath of heated molten metal to move the molten metal;

a shaft having an upper end suited to extend out of the molten metal, and a lower end suited for disposition into the molten metal, the shaft having a longitudinal shaft axis;

power means connected to the upper end of the shaft for rotating the shaft;

means for connecting the lower end of the shaft to the moving member for rotating the moving member in the molten metal;

an elongated tubular shield having a longitudinal shield axis, the tubular shield receiving the shaft therein such that the shaft axis coincides with the shield axis, the tubular shield having a length sufficient to substantially enclose that portion of the shaft disposed in the molten metal;

the tubular shield being formed of a material that is resistant to the heat of the molten metal;

means for longitudinally prestressing the tubular shield, comprising:

an upper clamping member mounted on an upper portion of the shaft and clampingly engaged with an upper portion of the shield;

a lower clamping member longitudinally spaced from the upper clamping member and mounted on a lower portion of the shaft and clampingly engaged with a lower portion of the shield;

means for adjusting the longitudinal distance between the upper clamping member and the lower clamping member to longitudinally clamp that portion of the shield therebetween;

whereby the shield is disposed such that the maximum longitudinal stress on the shield is in compression as it is rotated by the power means.

2. Apparatus as defined in claim 1, in which the shaft is hollow for passing a gas through the upper end of the shaft to a position adjacent the moving member.

3. Apparatus as defined in claim 2, in which the moving member is so joined to the lower end of the tubular shield as to form a gas chamber adjacent the lower end of the shaft for receiving gas from the upper end of the shaft; and including an orifice in the moving member for passing the gas into the molten metal in a downward direction generally parallel to the shaft axis.

4. Apparatus as defined in claim 2, including an inner shield having a radial surface and telescopically mounted in the first mentioned shield and laminated thereto;

a washer engaging the radial surface of the inner shield; and a clamping nut engaging the washer to apply a longitudinally compressive force on the inner shield.

5. Apparatus as defined in claim 4, in which the outer shield has a lower radial surface adjacent the radial surface of the first mentioned shield, and the washer engages the radial surface of both the first mentioned shield and the inner shield to longitudinally compress both of said shields along their respective lengths.

6. Apparatus as defined in claim 1, including:

the shaft having a longitudinal passage therethrough;

a source of a scrubbing gas;

means for introducing the scrubbing gas through the passage in the shaft into a bath of molten metal to remove hydrogen from the bath of molten aluminum.

7. Apparatus as defined in claim 1, in which the shield is formed of a ceramic.

8. Apparatus as defined in claim 1, in which the shield is formed from either a ceramic or a graphite.

9. Apparatus as defined in claim 1, in which the shield comprises at least one inner shield member and an outer shield member telescopically received in the inner shield member, such that an inner surface of the outer shield member faces an outer surface of the inner shield member and is attached thereto.

10. Apparatus as defined in claim 9, in which the moving member is attached to a lower portion of the outer shield member.

11. Apparatus as defined in claim 9 in which the inner shield member is disposed within the outer shield member to form a shoulder adjacent the moving member, and including one of said clamping members being mounted on the shaft and engaging said shoulder to longitudinally compress the shield members.

12. Apparatus as defined in claim 9 in which the inner shield member has an internal diameter greater than the outer diameter of the shaft to form a chamber therebetween.

13. Apparatus as defined in claim 1, including an upper clamping nut mounted on the shaft and engaged with the shield, and a lower clamping nut mounted on the shaft and engaged with the shield, and means for moving one of the clamping nuts toward the other of the clamping nuts to longitudinally compress the shield between the clamping nuts.

14. Apparatus as defined in claim 1, in which the moving member is an agitating member.

15. Apparatus as defined in claim 1, in which the moving member is a pumping member.

16. Apparatus as defined in claim 1, in which the shaft has a first coefficient of thermal expansion, and the shield has a second coefficient of thermal expansion such that the difference between the length of the shaft and the length of the tubular shield varies as a function of the temperature of the molten metal, and including a bias member mounted between the shaft and the tubular shield to accommodate the difference between the shaft and shield length.

17. Apparatus as defined in claim 16, in which the upper clamping member comprises a first nut threadably mounted on the upper end of the shaft; a second nut threadably mounted in the lower end of the shaft, a belleville or other suitable spring mounted on the shaft and between at least one of said nuts and the tubular shield to apply a compressive bias on the shield that varies as the difference in the variation of the lengths of the shaft and the shield.

18. Apparatus as defined in claim 1, in which the shaft has a first coefficient of thermal expansion, and the shield has a second coefficient of thermal expansion such that length of the shaft and the length of the tubular shield vary as a function of the temperature of the molten metal, and including a bias member mounted between the shaft and the tubular shield to accommodate differences between the shaft length and the shield length.

19. Apparatus for moving molten metal in a bath of molten metal, comprising:

a rotatable moving member suited to be disposed in a bath of heated molten metal;

a shaft having an upper end suited to extend out of the molten metal, and a lower end suited for disposition into the molten metal, the shaft having a longitudinal shaft axis;

power means connected to the upper end of the shaft for rotating the shaft;

means for connecting the lower end of the shaft to the moving member for rotating the moving member in the molten metal;

an elongated tubular shield having a longitudinal shield axis, the tubular shield receiving the shaft therein such that the shaft axis coincides with the shield axis, the tubular shield having a length sufficient to substantially enclose that portion of the shaft disposed in the molten metal;

the tubular shield being formed of a material that is resistant to the heat of the molten metal;

an upper fastener member mounted on the shaft;

a lower fastener member mounted on the shaft in a position longitudinally spaced from the upper fastener member;

the shaft and the tubular shield being formed of materials having different thermal expansion characteristics whereby the difference in the respective lengths of the shaft and the tubular shield varies as a function of their operating temperature; and a bias member mounted between the tubular shield and the shaft such that the distance between one end of the shaft and the corresponding end of the shield remains relatively fixed, and the distance between opposite end of the shaft and the shield varies as the temperature.

20. Apparatus as defined in claim 19, in which the shaft is hollow for passing a gas through the upper end of the shaft to a position adjacent the moving member.

21. Apparatus as defined in claim 19, including:

the shaft having a longitudinal passage therethrough;

a source of a scrubbing gas;

means for introducing the scrubbing gas through the passage in the shaft into a bath of molten metal to remove hydrogen from the bath of molten aluminum.

22. Apparatus as defined in claim 19, in which the shield is formed of a ceramic.

23. Apparatus as defined in claim 19, in which the shield is formed from either a ceramic or a graphite.

24. Apparatus as defined in claim 19, in which the shield comprises at least one inner shield member, and an outer shield member telescopically received in the inner shield member, such that an inner surface of the outer shield member faces an outer surface of the inner shield member and is attached thereto.

25. Apparatus as defined in claim 24, in which the moving member is attached to a lower portion of the outer shield member.

26. Apparatus as defined in claim 24, in which the inner shield member is disposed within the outer shield member to form a shoulder adjacent the moving member, and including one of said clamping members being mounted on the shaft and engaging said shoulder to longitudinally compress the shield members.

27. Apparatus as defined in claim 24, in which the inner shield member has an internal diameter greater than the outer diameter of the shaft to form a chamber therebetween.

28. Apparatus as defined in claim 19, including an upper clamping nut mounted on the shaft and engaged with the shield, and a lower clamping nut mounted on the shaft and engaged with the shield, and means for moving one of the clamping nuts toward the other of the clamping nuts to longitudinally compress the shield between the clamping nuts.

29. If Apparatus as defined in claim 19, in which the moving member is an agitating member.

30. Apparatus as defined in claim 19, which the moving member is a pumping member.

31. Apparatus as defined in claim 19, in which the moving member is so joined to the lower end of the tubular shield as to form a gas chamber adjacent the lower end of the shield from the hollow shaft; and including an orifice in the moving member for passing the gas into the molten metal in a downward direction generally parallel to the shaft axis.

32. Apparatus as defined in claim 19, including an inner shield having a radial surface and telescopically mounted in the first mentioned shield and laminated thereto;

a washer engaging the radial surface of the inner shield; and a clamping nut engaging the washer to apply a longitudinally compressive force on the inner shield.

33. Apparatus as defined in claim 19, in which the outer shield has a lower radial surface adjacent the radial surface of the first mentioned shield, and the washer engages the radial surface of both the first mentioned shield and the inner shield to longitudinally compress both of said shields.

34. Apparatus as defined in claim 19, which the upper clamping member comprises a first nut threadably mounted on the upper end of the shaft; a second nut threadably mounted on the lower end of the shaft, a belleville or other suitable spring mounted on the shaft between one of said nuts and the tubular shield to apply a compression bias on the shield that varies as the difference in the variation of the lengths of the shaft and the shield.

* * * * *